United States Patent [19]

Kaiser, Jr.

[11] 4,177,040

[45] Dec. 4, 1979

[54] STARTER FLUID FOR INTERNAL COMBUSTION ENGINES

[75] Inventor: Fay E. Kaiser, Jr., Niles, Mich.

[73] Assignee: U.S. Aviex Corp., Niles, Mich.

[21] Appl. No.: 921,845

[22] Filed: Jul. 3, 1978

[51] Int. Cl.[2] ..... C10L 1/16

[52] U.S. Cl. ..... 44/52; 44/53

[58] Field of Search ..... 44/52, 53

[56] References Cited

U.S. PATENT DOCUMENTS

| | | | |
|---|---|---|---|
| 3,361,544 | 1/1968 | Kaiser, Jr. | 44/52 |
| 3,697,240 | 10/1972 | Hori et al. | 44/52 |

*Primary Examiner*—Winston A. Douglas
*Assistant Examiner*—J. V. Howard
*Attorney, Agent, or Firm*—Oltsch, Knoblock & Hall

[57] ABSTRACT

A starter fluid consisting of a lower alkyl ether, a pressuring gas, a hydrocarbon propellant and petroleum distillate of 5 to 8 carbon chain length.

3 Claims, No Drawings

STARTER FLUID FOR INTERNAL COMBUSTION ENGINES

SUMMARY OF THE INVENTION

This invention relates to an improved engine-starting compound used for starting internal combustion engines, such as diesel engines, in extremely cold weather.

Heretofore as described in U.S. Pat. Nos. 3,255,786 and 3,361,544 fractionated hydrocarbon rubber solvents were used in conjunction with an ether, propane, $CO_2$ mixture. Such rubber solvents are characterized by a flash point in the range of −20° F. and −40° F. which is very near the flash points of the propane and ether utilized in the starter fluid. Thus, the rubber solvent, ether and propane could be exhausted before the ignition temperature of the fuel was reached. Even should the ignition temperature be reached it may not exist for a sufficient length of time to vaporize the fuel to initiate fuel ignition.

In this invention a combination of a lower alkyl ether, a $CO_2$ or nitrous oxide pressurizer, a hydrocarbon propellant of the class consisting of butane, iso-butane and propane, and a petroleum distillate with a 5 to 8 carbon chain is utilized for the starter fluid. In this combination, the petroleum distillate with its flash point between 10° F. to 30° F. will prolong the initial fire of the starting fluid. This will provide additional BTU's to increase the internal temperature of the engine cylinder due to the longer period of burn with the petroleum distillate continuing to burn after the ether and propane have been exhausted. By so prolonging the burning time of the starter fluid the fuel of the internal combustion engine is more easily ignited thus reducing the amount of time required to crank the engine and also the amount of starter fluid needed to obtain engine fuel ignition is reduced. Such an improved starter fluid is less costly to produce than the starter fluids disclosed in formerly mentioned U.S. Pat. Nos. 3,255,786 and 3,361,544 since either of lesser quality and in lesser amounts can be utilized. Additionally there is an improved burning propagation resulting in less initial thrust upon the engine components which is an important feature in gasoline engines which are not designed with the structural strength of diesel engines.

Accordingly, it is an object of this invention to provide a means of increasing the life of the initial fire of a starting fluid for an internal combustion engine.

Another object of this invention is to provide an internal combustion engine starting fluid having a high BTU production upon ignition so as to decrease the amount of fluid needed to ignite the fuel of the engine.

Still another object of this invention is to provide in an internal combustion engine starting fluid for the improved solubility of propane and ether causing increased ether vaporization and utilization.

Still a further object of this invention is to provide a starting fluid which is for internal combustion engines and which is of reliable operation.

Still another object of this invention is to provide a starting fluid which is for internal combustion engines and which may be economically produced.

DESCRIPTION OF THE PREFERRED EMBODIMENT

The preferred embodiment illustrated is not intended to be exhaustive or to limit the invention to precise form disclosed. It is chosen and described to best explain the principles of the invention, its application and use to thereby enable others skilled in the art to utilize the invention.

The starting fluid of this invention is utilized in internal combustion engines, of both the diesel and gasoline type. The fluid in its mixed form is available for use in a sealed pressure-charged, valved aerosol type container with the fluid generally being under a pressure between 60 p.s.i. and 130 p.s.i. The starting fluid is introduced into the cylinders of the internal combustion engine which upon cranking of the engine causes the initial ignition or firing of the fluid followed by the ignition of the fuel within the cylinder of the engine.

In this invention the starting fluid is a mixture of a lower alkyl ether, such as diethyl ether or isopropyl ether, a hydrocarbon propellant of the type consisting of butane, iso-butane and propane, a pressurizer which is preferably $CO_2$, nitrous oxide, or a combination of $CO_2$ and nitrous oxide, and a petroleum distillate of the type having 5 to 8 carbon chains or an isomer thereof. Such petroleum distillate will be either pentane, heptane, septane, or octane or mixture thereof.

The proportion of the components of the fluid mixture is with the ether being 35 to 65% by volume, the hydrocarbon propellant from 4 to 8% by volume, the pressurizer being 3 to 5% by volume and the petroleum distillate being 36 to 52% by volume.

A preferred starting fluid of this invention is of the following components and proportions:

Diethyl ether—40%
Propane—6.7%
$CO_2$—3.3%
Petroleum Distillate—50%

The ether and hydrocarbon propellant are introduced into the aerosol container in liquid form and remain so until expelled from the container.

The starter fluid of this invention which utilizes a petroleum distillate in combination with a hydrocarbon propellant of either butane, iso-butane or propane or mixture thereof and an ether causes the improved solubility of the propellant with the ether which in turn causes earlier partial vaporization of the ether, permitting earlier combustion of the starter fluid. Additionally the starter fluid of this invention produces an improved flame propagation with the flame having a greater burning range to produce more significant BTU's, thereby resulting in a faster starting of the engine.

It is to be understood that the invention is not to be limited to the details above given but may be modified within the scope of the appended claims.

What I claim is:

1. A starter fluid for internal combustion engines confined in a sealed pressure-charged, valved aerosol type spray container consisting essentially of:
   - a lower alkyl ether, from 35 to 65% by vol.;
   - a pressurizing gas from 3 to 5% by vol.;
   - a hydrocarbon propellant from 4 to 8% by vol.; and
   - a petroleum distillate of the class consisting of 5 to 8 carbon chains or any isomer thereof, from 36 to 52% by volume.

2. The starter fluid of claim 1 wherein
   - said lower alkyl ether consists of a class of diethyl ether and iso-propyl ether,
   - said pressurizing gas consisting of $CO_2$, nitrous oxide and mixtures thereof, and
   - said hydrocarbon propellant of the class consisting of butane, iso-butane and propane.

3. The starter fluid of claim 2 wherein said lower alkyl ether is diethyl ether at 40% by volume, said pressurizing gas is $CO_2$ at 3.3% by volume, said hydro-carbon propellant is propane at 6.7% by volume and said petroleum distillate is at 50% by volume.

* * * * *